US005903994A

United States Patent [19]

Tange

[11] Patent Number: 5,903,994

[45] Date of Patent: May 18, 1999

[54] NORMALLY-ON SAFETY ON A PISTOL, AND METHOD OF CONVERTING A PISTOL TO INCLUDE A NORMALLY-ON SAFETY

[76] Inventor: Mark L. Tange, 14991 Coutolenc Rd., Magalia, Calif. 95954

[21] Appl. No.: 08/972,757

[22] Filed: Nov. 18, 1997

Related U.S. Application Data

[60] Provisional application No. 60/031,392, Nov. 19, 1996.

[51] Int. Cl.[6] ..... F41A 17/00

[52] U.S. Cl. ..... 42/70.01

[58] Field of Search ..... 42/70.01

[56] References Cited

U.S. PATENT DOCUMENTS

| | | | |
|---|---|---|---|
| 580,924 | 4/1897 | Browning | 89/145 |
| 978,092 | 12/1910 | Wesson | 89/148 |
| 984,519 | 2/1911 | Browning | 89/138 |
| 1,070,582 | 8/1913 | Browning | 89/148 |
| 1,376,165 | 4/1921 | Rosebush | 42/70.01 |
| 2,846,925 | 8/1958 | Norman | 42/70.01 |
| 3,159,080 | 12/1964 | Freed | 89/148 |
| 3,492,748 | 2/1970 | Swenson | 42/70.01 |
| 4,414,769 | 11/1983 | Mueschke | 42/70 R |
| 4,422,254 | 12/1983 | McQueen | 42/17 |
| 4,590,697 | 5/1986 | Ruger et al. | 42/70 F |
| 4,742,634 | 5/1988 | Swenson | 42/70.01 |
| 4,800,665 | 1/1989 | Schumaker | 42/70.01 |
| 5,090,147 | 2/1992 | Pastor | 42/70.05 |

OTHER PUBLICATIONS

Manual of the Automatic Pistol, Caliber .45, Model of 1911 age of "manual" unknown, but published at least 20 years ago.

*Primary Examiner*—Charles T. Jordan
*Assistant Examiner*—Meena Chelliah

[57] ABSTRACT

A firearm, namely an automatic pistol such as a Model 1911, 1911 Al or the like structured to include a first portion of an elongate spring rod mounted in a space in a grip panel, and a second portion of the spring rod positioned within a notch in a thumb safety lever adjacent the grip panel. The spring rod is positioned to continuously bias the safety lever into the on-safe position wherein components of the pistol such as the hammer and trigger are locked to prevent discharge of the pistol. The safety is normally-on so that the pistol cannot be discharged absent the shooter intentionally and continuously depressing the safety lever into the off-safe position in order to discharge the pistol. The safety lever is continually biased by the spring into the safety-on position, thereby the shooter must continue to depress the thumb safety lever, overriding the spring, in order to discharge the pistol. Generally instantaneously upon the shooter releasing the safety lever, the spring returns the safety into the safe-on position wherein again the pistol cannot be discharged. In one preferred embodiment are two safety levers identically functional, one on each side of the pistol frame near the grip panels to allow the pistol to be considered ambidextrous to provide advantages to both left and right handed shooters in critical self-defense situations. Methods describing the ready converting of existing pre-manufactured pistols to include normally-on, momentary-off safeties are also disclosed.

6 Claims, 5 Drawing Sheets

NORMALLY-ON SAFETY ON A PISTOL, AND METHOD OF CONVERTING A PISTOL TO INCLUDE A NORMALLY-ON SAFETY

The benefit of the filing date of my Provisional application number 60/031,392 filed Nov. 19, 1996 is herein claimed for the common material.

BACKGROUND OF THE INVENTION

1. Field of the Invention

The present invention relates to firearms such as pistols having manually manipulable safety mechanisms operable by the shooter's thumb of the pistol grasping hand. Methods of or for readily converting existing pistols to include normally-on, momentary-off safety mechanics in accordance with the invention are also disclosed.

2. Description of the Prior Art

Prior art devices referred to as manual safeties for firearms generally fall into two categories. The first category are those safeties which are present on the firearm and are deactivated or placed into the "off safe" position by the shooter merely grasping or mounting the firearm in the shooting hand of the shooter. A good example of this type of safety is the "grip lever" safety as seen in U.S. Pat. No. 984,519 issued Feb. 14, 1911 to John M. Browning. The purpose of this type of safety on pistols is to prevent the pistol from discharging when the pistol chamber is loaded, ready to fire and the pistol is not properly positioned in the hand of the shooter.

The second category of safeties are those which are manually activated or deactivated by the decision of the shooter. These manual safeties are characteristically situated on the frame or the slide of the pistol in the proximate area of where the shooter's thumb is positioned when the pistol is maintained in the proper method of gripping the pistol. These manual safeties are positioned so as to allow their manipulation by the thumb of the shooter without compromising the secure grasp of the pistol allowing it to be held in readiness for immediate use. These manually operated thumb safeties have two positions, that being the "on safe" or activated position and the "off safe" or deactivated position. These safeties are held in one of these positions, usually by a spring-loaded mechanical device designed into the pistol, until the shooter changes the position of the safety of his own volition.

A good example of a pistol equipped with both a grip lever safety and a frame mounted thumb safety is seen in U.S. Pat. No. 1,070,582 issued Aug. 19, 1913 to John M. Browning. This Browning pistol is for all practical purposes the pistol known as the Government Model of 1911 or the Model 1911 A1 pistol. This pistol may be kept or stored in several conditions of readiness for use. By far the most advantageous condition for the purpose of self defense is with a loaded magazine, loaded chamber with the hammer at full cock and with the thumb safety in the activated, or "on safe," position. When the pistol is in this condition the pistol operator can best bring the pistol into immediate use by grasping the pistol by its grip, which deactivates the aforementioned grip safety lever by pressing it down into the deactivated or "off safe" position, then pushing off the thumb safety with the thumb of the shooting hand and pressing the trigger when the pistol sights have been aligned on the selected target. When the thumb safety is pressed down into the off position it is held there by a detent designed into the thumb safety which when in this position is aligned with a spring loaded plunger mounted on the frame of the pistol. The thumb safety is secured in the "off safe" position by this detent and plunger arrangement until pushed, intentionally or inadvertently, into the activated or "on safe" position by the thumb of the shooter.

Other examples of prior art which typify attempts to increase the potential safety of the aforementioned Browning designed pistol (U.S. Pat. No. 1,070,582) can be seen in U.S. Pat. No. 3,159,080 issued Dec. 1, 1964 to George H. Freed. In his attempt to make the pistol safer to use Freed compliments the manual or thumb safety on the pistol by attaching a rotating linkage which on one end is manipulated by the thumb of the shooter while the thumb is positioned at a lower position on the grip panel of the pistol. The movement of the linkage by the thumb can move the thumb safety to its on or off position as desired by the shooter. The mechanical nature and operation of the thumb safety is not altered with this device. The prime advantage of Freed's design is apparently to allow the shooter to control the thumb safety while keeping the thumb at a lower position on the grip of the pistol. An obvious disadvantage to the design is that while the device may allow easier manipulation of the thumb safety for some shooters the device also increases the likelihood of the thumb safety being inadvertently pushed into its "off safe" or deactivated position by nature of its added dimension to the grip panel of the pistol while the pistol is carried on the person of the shooter.

Another example of prior art which attempts to increase the potential safety of the Model 1911 style pistol can be seen in U.S. Pat. No. 5,090,147 issued Feb. 25, 1992 to Walter Pastor. In his design Pastor recognizes the potential probability of accidental discharge with the pistol and presents a designed addition and alteration to the pistol which requires a distinct procedure to deactivate the inherent safeties on the pistol in order for it to be discharged. Pastor relates how the pistol can be carried on the person or kept in a readily accessible place and brought into action quickly. He presents the problem where if the pistol is kept or carried with a loaded chamber, the hammer cocked and the thumb safety on and the shooter grasps the pistol the thumb safety could be inadvertently deactivated by error. He adduces the shooter would then proceed in handling the pistol possibly unaware the thumb safety was deactivated. His design when added to a Colt 1911 Model pistol would prevent the thumb safety from being deactivated until his device, which takes the place and function of the grip safety, is itself deactivated first.

Yet another example of prior art which attempts to increase the potential safety of firearms in general is found in U.S. Pat. No. 4,422,254 issued Dec. 27, 1983 to Sidney J. McQueen. McQueen's design provides an additional manually operated mechanical safety to the firearm by providing an obstacle to the insertion of the trigger finger of the shooter into the trigger guard of the firearm. This device merely adds an additional mechanical obstruction to prevent the firearm from being discharged. For pistols which already have a manual safety inherent in their design this device would merely slow the shooter from bringing the pistol into action which could, as a consequence, endanger the pistol handler if he were under imminent attack by an assailant.

An example of prior art which requires a constant and deliberate action in order for the pistol to be discharged is found in U.S. Pat. No. 978,092 issued Dec. 6, 1910 to Joseph H. Wesson. Wesson's design prevents the discharge of the pistol unless a thumb lever is constantly depressed by the thumb of the shooter. It is apparent when looking at Wesson's patent that his device is to be designed into the internal mechanism of the pistol thereby blocking the internal operating parts of the pistol to keep it from discharging until, and unless, the shooter depresses an external latch or lever mounted on the exterior of the frame of the pistol by the thumb or a finger of the shooter. This latch or lever must then be held or depressed into a particular position in order for the pistol to be discharged.

Wesson does not describe how to modify or restructure an already manufactured and existing pistol to include a normally-on, momentary-off safety, and particularly a Model 1911 or 1911 A1 pistol of which there are millions in existence. Wesson additionally fails to suggest or recognize the importance of having such a normally-on, momentary-off type safety arranged such that the safety can be deactivated to allow firing of the firearm by either of the shooter's single hands on the pistol wherein the shooter can use either the right or left hand on the same pistol, such as with ambidextrous type safeties.

A pistol such as Wesson's of U.S. Pat. No. 978,092 having the normally-on, momentary-off safety with the thumb depressible safety release lever on only one side of the pistol has shortcomings which become apparent under certain critical self defense conditions. For example, if the shooter normally shoots with his right hand and the thumb safety lever is a normally-on, momentary-off safety and is only on the left side of the pistol frame as shown and described by Wesson, and the shooter's right hand or right thumb should become disabled during a critical period of self-defense, then, due to the injury the shooter would not be able to hold the pistol in his right hand and depress the left side thumb safety lever to fire the pistol. However, if the pistol were to include two functionally identical thumb safety levers, one lever on either side of the frame (as herein described as one embodiment of the present invention) and is normally on-safe, momentary-off, then the injured shooter could switch hands on the pistol and still be able to depress the thumb safety lever and discharge the firearm, a situation wherein it can be appreciated that absent the second safety lever on the other side of the pistol frame and with the pistol having the normally-on safety, the shooter would be unable to defeat the safety and fire the pistol with his single remaining uninjured hand and thumb, and therefore there could be very serious consequences absent such a pistol being ambidextrously arranged. Another reason for having a pistol normally safe-on, momentary-off and ambidextrous in regards to the thumb safety levers to defeat the safety, is that when a right hand shooter is taking cover behind an object such as a wall which terminates to the shooter's left side, the shooter taking cover because shots may be fired at him from an enemy, the right hand shooter in order to shoot beyond the wall would need to maintain the pistol in his right hand in order to be able to defeat the normally on-safe thumb safety lever on the left side of the frame with his right thumb, and such would require the shooter to expose much more of his body as a potential target in shooting around the edge of the wall than if the pistol were arranged ambidextrous or had a thumb safety lever also on the right side of the pistol frame. If in this scenario the pistol had both a left and right side thumb safety lever, the shooter could switch the pistol to his left hand and be able to place his left hand thumb atop the right side thumb safety lever to move the lever and pistol into the off-safe position wherein the shooter could fire the pistol around the edge of the wall with far less exposure of his head and chest as a potential target.

Additionally noteworthy in the prior art are pistols which include thumb manipulable safeties which are structured for ambidextrous use wherein a portion of the safety is positioned on each of two sides of the pistol to allow manual manipulation of the safety with either the right or left hand thumb. Such ambidextrous safeties are not known to have been structured to have any "normal" position, but are structured to be flipped into either on-safe or off-safe positions and to remain in such position until again flipped into the opposite position.

Most, if not all pistols manufactured having a single thumb safety levers have the thumb lever on the left side of the pistol or pistol frame for use of the pistol in the right hand. Such pistols have been difficult to use safely by left handed shooters, and thus ambidextrous safety levers, one lever on each side of the pistol were produced as after-market add-ons to allow left hand thumb control of the manual safety and shooting of the pistol.

Although there are other ambidextrous safety structures in use in the prior art, an example of an ambidextrous safety may be examined in U.S. Pat. No. 4,414,769 issued Nov. 15, 1983 to H. Mueschke.

SUMMARY OF THE INVENTION

The present invention involves firearms, namely pistols, and primarily an automatic pistol such as a Model 1911, 1911 A1 or the like, and structured in accordance with the invention to include a spring positioned to continuously bias the thumb safety lever and associated safety mechanics into the on-safe position wherein components of the pistol such as the hammer and trigger are locked to prevent discharge of the pistol. The safety is normally-on so that the pistol cannot be discharged absent the shooter intentionally and continuously depressing the safety lever into the off-safe position in order to discharge the pistol. The safety lever is continually biased by the spring into the safety-on position, thereby the shooter must continue to depress the thumb safety lever, overriding the spring, in order to discharge the pistol. Generally, instantaneously upon the shooter releasing the safety lever, the spring returns the safety into the on-safe position wherein again the pistol cannot be discharged. In one preferred embodiment are two safety levers identically functional, one on each side of the pistol frame near the grip panels to allow the pistol to be considered ambidextrous to provide advantages to both left and right handed shooters in critical self-defense or combat situations. Methods describing the ready converting of existing pre-manufactured pistols such as Model 1911 style and the like to include normally-on, momentary-off safeties are also disclosed.

Firearms are, by their nature, tools with the inherent ability to cause death and injury to persons and destruction to property. Their proper and safe use is of paramount concern to the responsible firearm operator, persons in general, their government and the manufacturers of firearms who diligently attempt to provide commercially viable and safe firearms to the marketplace.

All modern firearms are equipped with safety mechanisms which are overcome or deactivated by the firearm user when the firearm is to be discharged. Unfortunately, no matter how many safeties are designed into the firearm they can all be defeated by carelessness, or a moment of inattention on the part of the shooter. Consequently, a firearm which has been fitted with an additional safety measure (i.e. a locking device over some operative part of the firearm for example) could negate the use of the firearm for the purpose of immediately bringing the firearm into use for the purpose of self defense or the defense of others in an emergency. If a firearm, particularly a pistol, is kept ready for emergency use in the home or on the person it must be able to be brought into effective use without looking for a key or remembering a combination. It must be ready without additional steps necessary for its operation other than to bring it from its place of storage or concealment, to the hand of the shooter and ready for operation if the need arises. When too many safety measures are incorporated into such a situation many times the prospective user will recognize the time lag caused by these safeties and he may compromise them for the sake of speed and convenience. My invention will provide an improved firearm safety arrangement without causing any loss of time in bringing the pistol into action during an emergency.

My invention recognizes the well designed pistol having a frame-mounted, manual thumb safety lever and compliments its abilities to help make the pistol operate properly and safely by requiring a conscious and constant deactivation of the manual thumb safety by the firearm operator in order for the pistol to be discharged.

The invention of this disclosure is to assist the shooter of firearms in providing an additional degree of safety in the operation of the pistol structured in accordance with the invention by automatically activating the manual thumb safety lever and trigger and hammer locking components of the pistol when the safety lever is not being constantly held in the deactivated or "off safe" position by the thumb of the shooter. This will significantly help prevent the pistol from being fired unintentionally by the trained shooter or by anyone not knowledgeable or trained to operate the pistol.

The present invention installed or incorporated into or onto a pistol would mandate the shooter maintain a conscious, constant pressure on the thumb safety in order to keep it in the deactivated or "off safe" position when the shooter is preparing to discharge the pistol. When the pistol operator intentionally or inadvertently releases pressure from the thumb safety, the thumb safety automatically returns to the activated or "on safe" position thereby preventing the pistol from discharge. On some pistols with this type of safety located on the frame in the area of the thumb of the shooter, the invention would also accomplish another function other than keeping the pistol from discharging. For example, the manual thumb safety on pistols such as that described in U.S. Pat. No. 1,070,582 issued Aug. 19, 1913 to John M. Browning also locks the pistol slide in the closed or full battery position. This feature of this class of pistol, when improved with the invention would prevent anyone not trained or familiar with its operation from initially operating the slide without maintaining a constant pressure on the manual thumb safety forcing it into its "off safe" position. This feature would hinder and confuse the untrained or unauthorized handler in the act of operating the slide of the pistol which, if the chamber were not loaded with a live cartridge, hinder them from readily loading and discharging the pistol. Any pistol in accordance with the invention would therefore help prevent accidental discharges by the authorized, knowledgeable and trained shooter of the pistol as well as unauthorized persons who may come in contact with the pistol such as children or assailants who have successfully gained possession of the pistol through misappropriation.

The operation of the pistol in accordance with the invention would not be unfamiliar to those trained in the proper technique of its use, but initially difficult to master by those who are unfamiliar with it. Thus, even if the pistol in accordance with the invention were unlawfully seized from its owner by an assailant, the assailant would be perplexed as to its operation and this could provide an opportunity for the lawful owner of the pistol to forcefully regain the initiative in such a conflict or flee the immediately effective range of the pistol before the assailant could become familiar enough with the operation of the pistol to use it against its lawful and rightful owner.

A pistol in accordance with the invention would instill its owner with a greatly increased perception, and actuality, of safety for the pistol, and greatly reduce the probability of unintentional firearms discharges while the pistol is mounted in the proper grip of the shooter. If the pistol is accidentally dropped or wrested from the grasp of the shooter, it will automatically actuate or maintain the frame-mounted manual thumb safety in the activated or "on safe" position automatically and immediately upon the pistol leaving the controlling grasp of the shooter.

It must be noted that due to the nature of the invention when installed on a pistol where the user wishes to operate the firearm with either hand, the pistol frame-mounted thumb safety can be of the ambidextrous variety which could be viewed as critical in some self defense situations.

The present invention can be installed in a newly manufactured pistol or retrofitted into an existing pistol and in a manner in or on the pistol which would provide for the automatic actuation of the pistol frame mounted thumb safety.

BEST MODES FOR CARRYING OUT THE INVENTION

Figure 1:
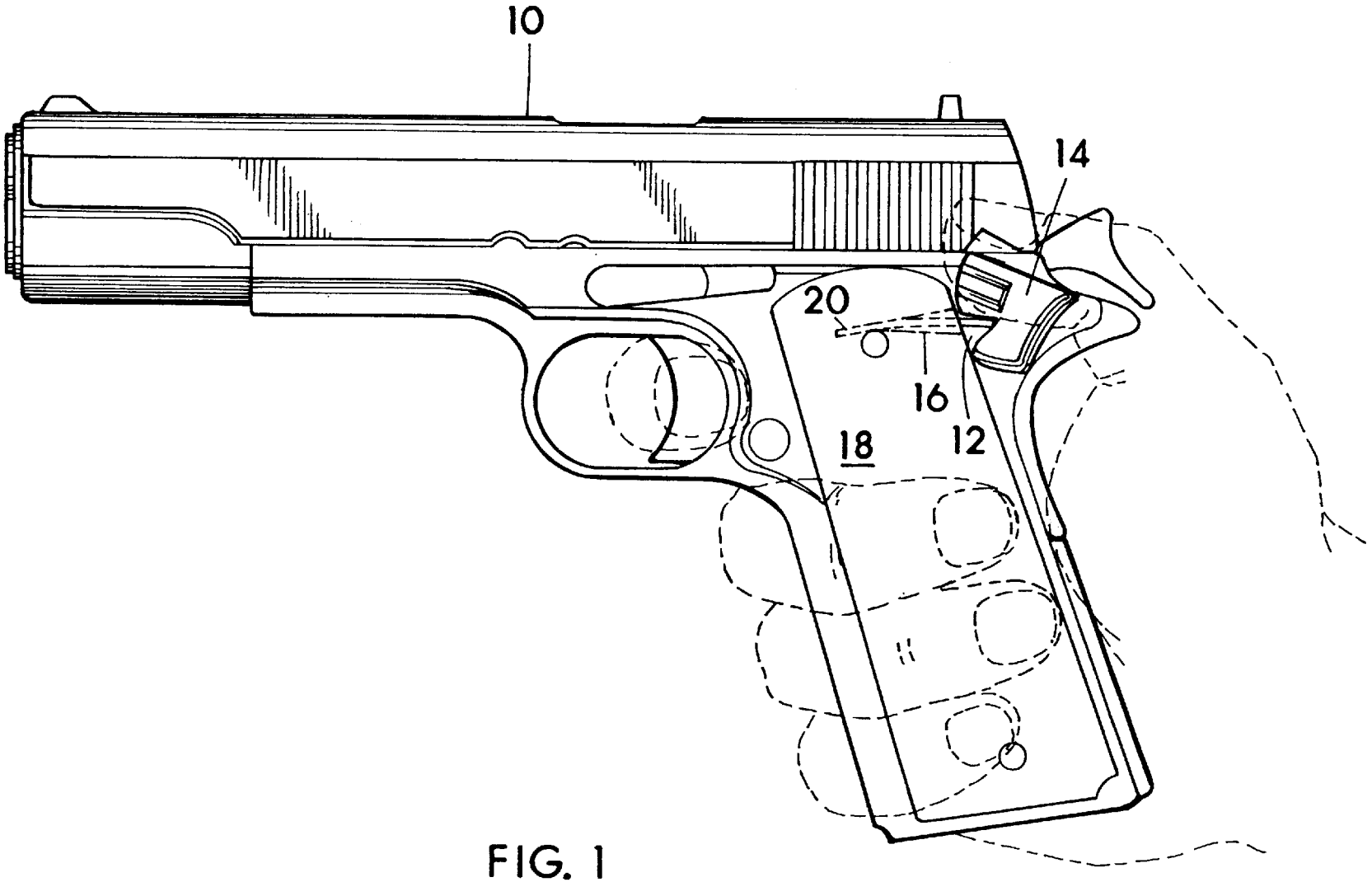
FIG. 1 is a perspective view of the left side of a pistol improved in accordance with the present invention with the thumb safety lever retained in the "off safe" position by the shooter's thumb.

Referring now to the drawing in general for a detailed description of structures and methods in accordance with the principles of the present invention. The present invention is firstly or primarily, but not exclusively, directed to automatic pistols of the structural type commonly and widely referred to as the Model 1911 or 1911 A1 which are automatic breech-loading and recoil operated. The Model 1911 A1 is for all practical purposes the same structure of pistol as the Model 1911 only with the Model 1911 A1 having a few very minor exterior angular differences from the Model 1911, and therefore I will generally refer to the pistol as the Model 1911 as it is most widely known. The Model 1911 pistol is basically the result of inventive pistol developments by John M. Browning as exhibited by Browning's U.S. Pat. No. 580,924 issued Apr. 20th 1897; U.S. Pat. No. 984,519 issued Feb. 14, 1911 which describes improvement in the 1897 pistol, and U.S. Pat. No. 1,070,582 issued Aug. 19, 1913 to Browning which describes improvements in the pistol of U.S. Pat. Nos. 984,519 of 1911 and 580,924 of 1897. The Model 1911 pistol most closely resembles in structure, function and appearance the Browning pistol of U.S. Pat. No. 1,070,582 issued in 1913. Although the Model 1911 pistol is most nearly structured in accordance with the pistol of Browning's 1913 U.S. Pat. No. 1,070,582, the pistol became widely known and recognized by the name Model 1911. The Browning U.S. Pat. No. 984,519 of 1911 did not therein describe a thumb safety lever capable of locking the breech-slide, while the Browning pistol of U.S. Pat. No. 1,070,582 of 1913 included a description of a thumb safety lever on the left side of the frame for actuating or moving a stud connected to the inward side of the lever and within the pistol into a position of locking cartridge firing components such as the hammer and the trigger (by locking the sear) in positions against being able to move to cause a discharge of a cartridge within the chamber and the firing of a bullet. The thumb safety lever of the pistol of Browning's 1913 patent when moved upward into the "on safe" position also moves into an exposed notch in the breech-slide to prevent movement of the breech-slide. The Model 1911 pistol includes such safety structural components wherein the shooter can manually move the pivotally mounted thumb safety lever upward into the on-safe position wherein the trigger, the hammer and the breech-slide are secured or locked against causing the discharge of a cartridge (making the pistol non-fireable), and the shooter can, at will, using thumb pressure depress the thumb safety lever downward to move the safety lever and move the attached internal lock stud to a position wherein the trigger (sear) and hammer can be actuated (moved) to cause the discharge of a cartridge and firing of a bullet, and the breech-slide is unlocked to allow the cycling of the pistol. With the Model 1911 style pistol, the thumb safety lever will reside in the off safe or downward position (pistol in fireable state) when pushed into such position, and will not return to a on-safe position (pistol in non-fireable state) until manually moved thereto, with this type of safety arrangement being that which is incorporated into the Model 1911 and pistols manufactured following the 1911 general format or structuring, although breech-slide locks are not always present in some pistols which are otherwise very similar to the Model 1911. The only possibly significant difference between the Browning pistol of U.S. Pat. No. 1,070,582 and the Model 1911 pistol of which I am aware is that the pistol of U.S. Pat. No. 1,070,582 included a magazine release button which also locked the trigger when the magazine was not installed in the magazine receiver, and the Model 1911 or 1911 A1 to my knowledge were never manufactured to include a combination magazine release and trigger lock button, but only have the magazine release aspect associated with the button mounted near the trigger and trigger guard.

The Model 1911 pistol, although it might have been possibly most accurately called the "model 1913", was widely distributed in the past and is still today sold to the citizenry in the U.S., and was the standard issue pistol of the U.S. military for many decades, from before World War I through the Vietnam conflict, and consequently the Model 1911 pistol and the structure defining the pistol is very well known to those skilled in the art. There are possibly millions of Model 1911 type or style pistols in the U.S. today. The Model 1911 pistol was manufactured in large numbers for individuals and the military by Colt firearms and other arms manufacturers, and is today manufactured and sold by numerous firearms manufacturers. The Model 1911 pistol has changed very little from that shown in the Browning U.S. Pat. No. 1,070,582, and in fact basically there have been no appreciable changes to the basic design. The Model 1911 pistol is considered to be a very safe design of pistol because of its many well thought-out safety features including the trigger lock, hammer lock, and breech-slide lock operatively associated with the thumb safety lever, i.e., engaged and disengaged with movement of the thumb safety lever, and the pistol additionally includes the grip safety which must be depressed (to free the trigger to allow movement thereof) before the pistol can be fired. Although the Model 1911 is a very safe design of pistol, the present disclosure seeks to teach how to make or render such a pistol as the Model 1911 or an equivalent pistol possibly called by another name, and which may or may not include the breech-slide lock aspect, even more safe without hindering or slowing the normal skilled use of the pistol.

Figure 7:
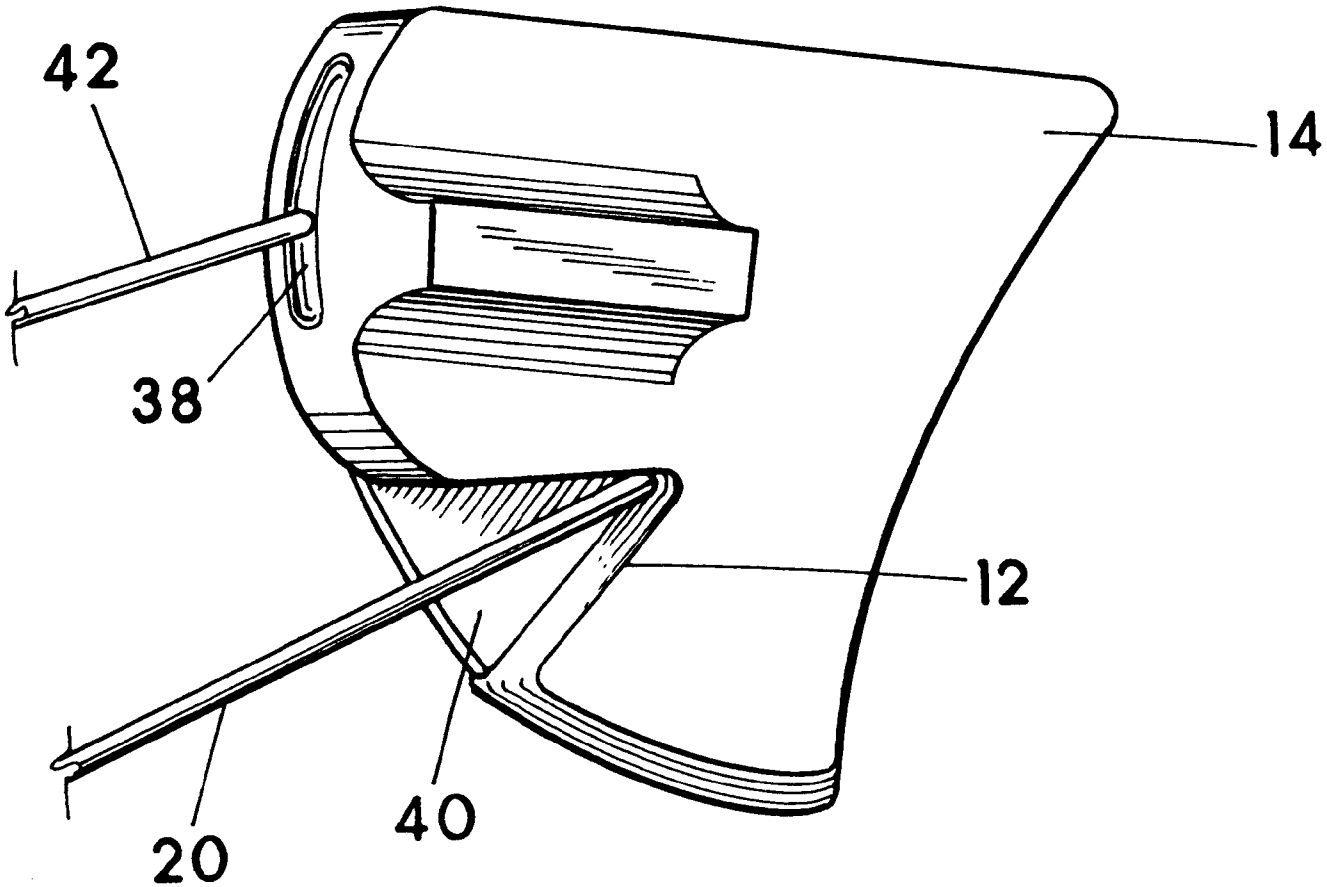
FIG. 7 shows a perspective view of a thumb safety lever, shown greatly enlarged, and useful within the scope of the invention.

The Model 1911 pistol is well known to those skilled in the art and is described in the aforementioned 1913 Browning U.S. Pat. No. 1,070,582 and the earlier Browning patent mentioned therein, however a brief description of the pistol follows. The part names sometimes vary from the Browning descriptions and the names for the identical parts referred to in certain manuals and other descriptions of the same or equivalent pistol, however, those skilled in the art understand the pistol and the various part names. A Model 1911 pistol includes the following basic components: a frame having a grip portion with grip panels (stocks) removably attached on each of two sides thereof; a barrel mounted on the top of the frame; a breech-slide with breech-block movably connected to the frame for forward and rearward movement relative to the frame and the breech-slide covering most of the barrel; a chamber portion of the barrel for holding a cartridge ready to fire a bullet; a magazine for holding multiple cartridges and for feeding the cartridges by a follower and spring into the breech and then the chamber responsive to movement of the breech-slide; a magazine receiver within the grip of the pistol for removably holding the magazine; a movable and cockable hammer for striking a firing pin which in-turn can strike the primer of a cartridge within the chamber; a mainspring for biasing the hammer toward the firing pin; a spring biased sear for releasably holding the hammer in a cocked position and which is pivotally mounted to be moved by pressure against the trigger to release the spring loaded cocked hammer so the hammer strikes the firing pin; a trigger depressible by the human finger to manipulate the sear and release the hammer to cause the firing of a cartridge; a trigger guard mounted to the frame and surrounding the trigger mainly for safety purposes; an extractor and an ejector system for ejecting a spent shell or casing from the open breech; a reaction or recoil spring for returning the breech-slide to a forward and breech closed position such as after the pistol has been fired and the casing ejected and a cartridge moved into the chamber from the magazine; a disconnector pin or safety mechanism to prevent the firing of the pistol should the breech-slide move only partially forward and only partially close the breech such as in a malfunction; a grip safety panel which normally locks the trigger or otherwise prevents discharge of a cartridge until the grip safety panel is manually depressed with a proper grasping of the grip of the pistol. The pistol is fired by reciprocating motion of the trigger, wherein the shooter's finger moves the trigger inward toward the grip and the internal movable parts (sear and spring thereof mainly) of the pistol move the trigger back outward into the ready position. The pistol can be fired as rapidly as the shooter can squeeze and let-up on the trigger until such time as all of the cartridges have been fired. The breech-slide locks into the rearward breech open position following the last cartridge being fired and the casing thereof ejected from the pistol, a clear indication to the user that the pistol is out of ammunition. The pistol also includes the left side thumb lever safety as above described and detailed in the 1913 U.S. Pat. No. 1,070,582 for locking the trigger, the hammer (cartridge firing components), and the breech-slide when pivoted into the on-safe position (up toward the breech-slide), and for releasing the trigger, hammer and breech-slide to allow them to move upon pressure applied to the trigger for causing firing of the pistol, if the grip safety is properly depressed as above described. The pistol also includes an outwardly biased knob, biased by a spring within a tube, the knob biased outward to press against the side edge of the thumb safety lever and to reside in one or the other of two spaced positions or recesses in the thumb lever primarily to aid in retaining the thumb safety lever either in the on safe or off safe positions, and secondarily to aid in preventing the lateral outward movement of the lever from the frame of the pistol. An outward biased knob is indicated in FIG. 7 at 42. The pistol includes additional other components which are well known to those skilled in the art and which will not be herein detailed or detailed to any extent.

The present invention relates to improvements in such a pistol, and herein described is an improved pistol such as a Model 1911 or equivalent structured in accordance with the invention, and a method of converting such a pistol already in existence into an improved pistol.

Figure 2:
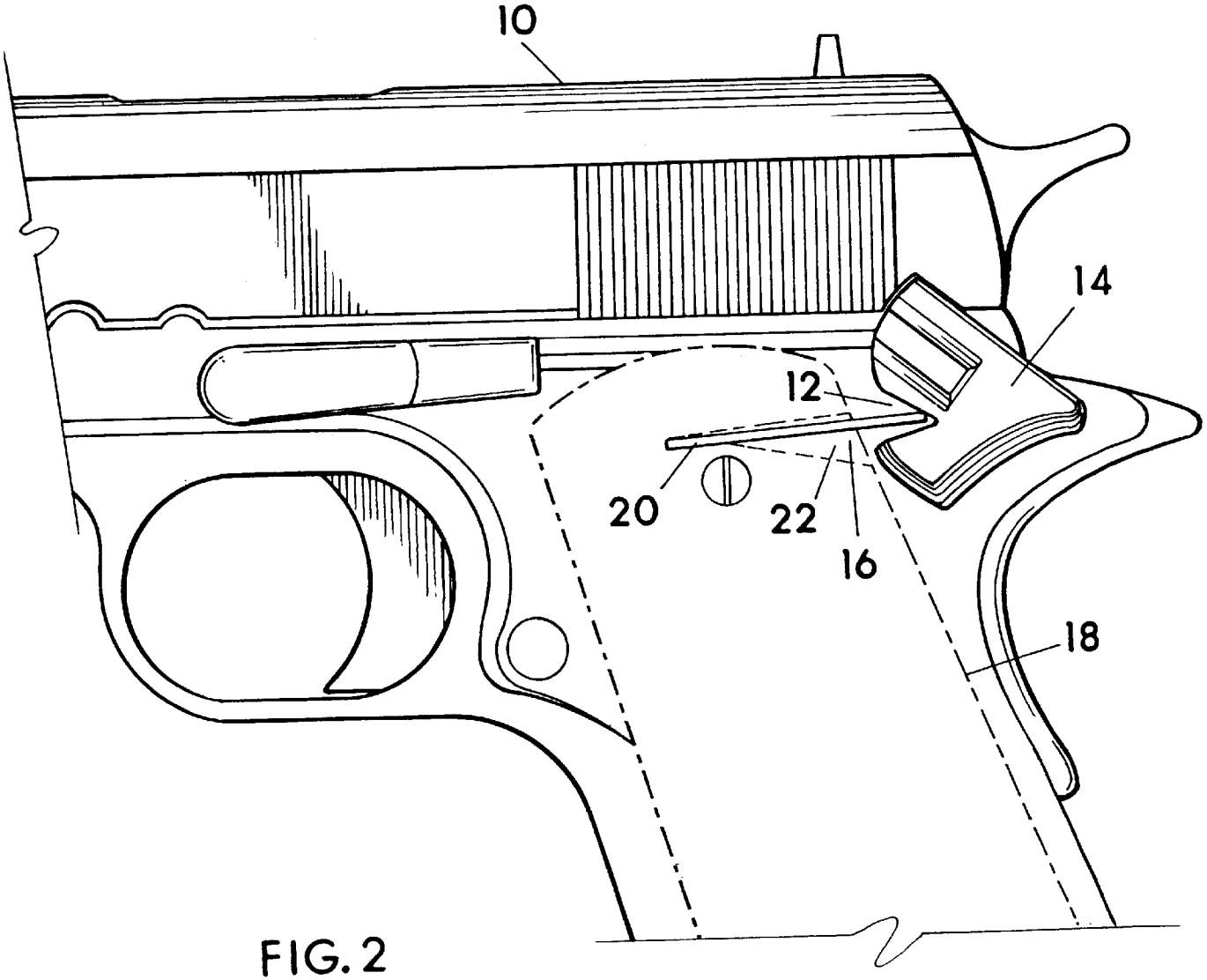
FIG. 2 is a partial left side of the FIG. 1 pistol with the thumb safety lever in the "on safe" and normal position.
Figure 4:
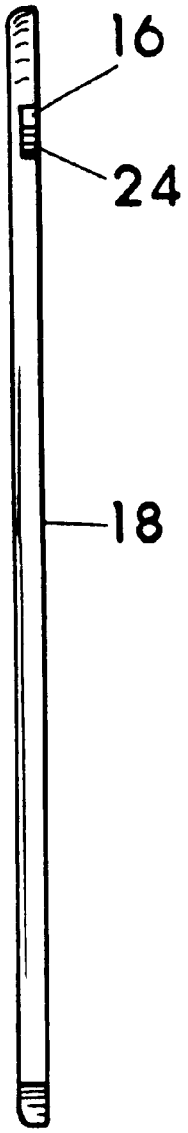
FIG. 4 is an enlarged edge view of the FIG. 3 grip panel.
Figure 3:
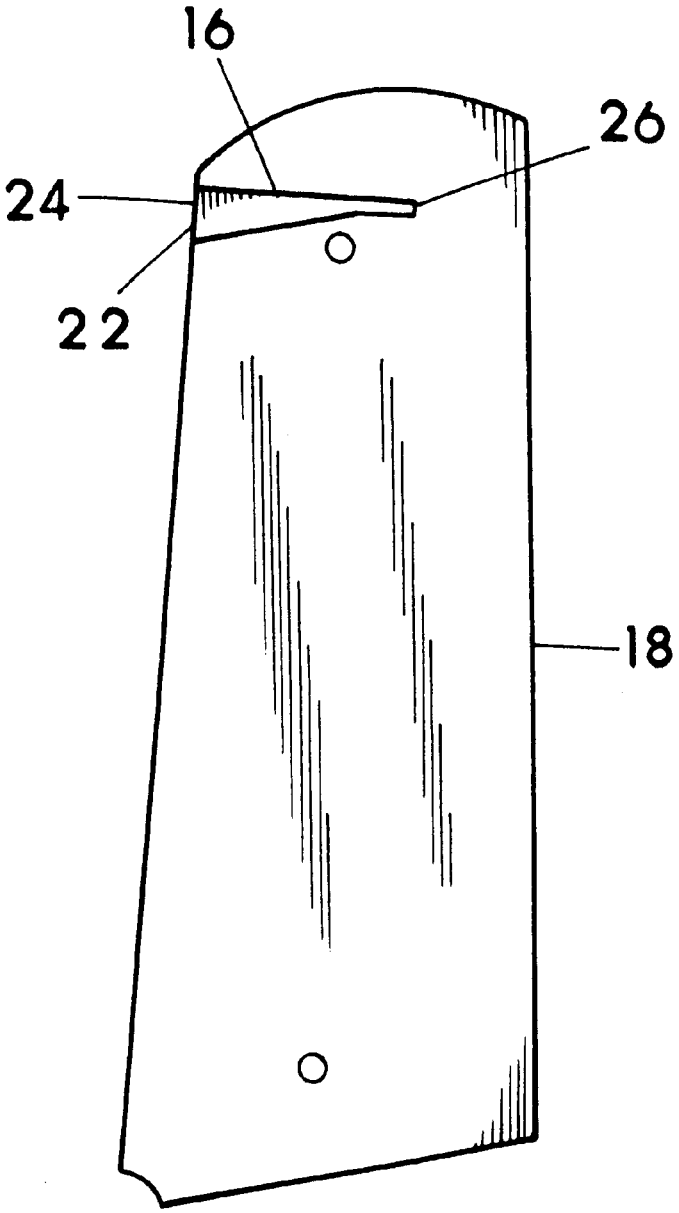
FIG. 3 is a perspective of the inner side of the grip panel removed from the pistol with the groove or space provided for a spring rod.

From one viewpoint, the invention can be viewed as methods or steps of converting a Model 1911 pistol or style pistol into a pistol which includes a normally-on, momentary-off safety associated with the exposed thumb safety lever and its associated attached lock stud for locking the hammer and trigger positioned internally of the pistol. The method of converting a Model 1911 style pistol into a pistol which includes a normally-on, momentary-off safety associated with the exposed thumb safety lever on the left side of the frame can be described as follows. It should be noted that the precise order of some steps relative to other steps can be altered or in other words in some cases the order of the steps relative to one another can be rearranged to readily achieve the same end result but remaining within the scope of the invention as those skilled in the art will recognize upon continued reading. Such steps can include:

(a) removing the existing grip panel (stock) adjacent to the existing left side thumb safety lever from the pistol 10; this typically requires only the removal of two mounting screws used to retain the grip panel on the frame grip portion;

(b) mounting a modified grip panel 18 onto the pistol in the location of the previously removed grip panel; the modified grip panel 18 can be identical to the removed grip panel except it is modified to define an elongate groove or space 16 on the back side of the grip panel and having an opening 24 into the space 16 adjacent the existing safety lever (see attached drawings and particularly FIGS. 3 and 4); the modified grip panel 18 can be a newly manufactured grip panel manufactured to include the space 16, or alternatively the removed grip panel can be cut, sawn or chiseled or the like to remove material therefrom to define the groove or space 16 with exit opening 24 in the grip panel; the mounting of the modified grip panel 18 requires or allows the reapplication of the two grip panel mounting screws;

(c) removing the existing safety lever from the left side of the pistol 10, a procedure which requires the pressing-out of only one pin permanently connected to the back side of the thumb safety lever and about which the lever pivots, the pin extending transversely through the frame of the pistol 10 to the right side of the frame, the pin pivotally mounting the safety lever to the frame and frictionally retained in the frame, once pressed inward the pin allows the thumb safety lever to be removed (pulled away) from the frame and pistol; removal of the thumb safety lever withdraws the permanently connected lock stud of the lever from a hole in the side of the frame, the stud (k3 in the Browning 1913 U.S. Pat. No. 1,070,582) being the piece or item moved up and down in a slight arc with like movement of the safety thumb lever to block or lock cartridge firing components such as the hammer and or trigger when in the up position and release the hammer and or trigger when in the down position;

(d) mounting a modified safety lever 14 onto the pistol in the location of the previously removed safety lever; the modified safety lever 14 can be identical to the removed safety lever but modified to define an opening or notch 12 (see FIGS. 1–2, 5) sized and positioned to receive a second portion or end of a spring rod 20 which will become understood with continued reading (see attached drawings and particularly FIGS. 1, 2, 5); the modified thumb safety lever 14 having notch 12 can be the removed thumb safety lever having been cut or otherwise modified to include the notch 12, or it may be a newly manufactured thumb safety lever originally manufactured to include the notch 12; notch 12 can have a thin floor 40 adjacent the side of the frame of the pistol with the end of spring 20 resting atop the floor 40 (see FIG. 7) which could aid in holding both the spring 20 and lever 14 in proper place on the pistol;

(e) installing an elongate flexible and resilient spring rod 20 under bending load into the space 16 of the modified grip panel and extending into the notch 12 of the modified safety lever 14 with the bending load when the spring 20 is fully installed biasing and pushing against (due the positioning of spring 20) the modified thumb safety lever 14 and pushing the thumb safety lever into the on-safe position (as shown in FIG. 2); the spring rod 20 being of sufficient flexibility to allow manual depression of the modified thumb safety lever 14 into the off-safe position (see FIG. 1), the spring rod 20 also being of sufficient resiliency to return the modified thumb safety lever 14 into the on-safe position upon release of manual depression there against.

If the spring biased knob normally present on such a pistol as mentioned above to help retain the thumb safety lever stationary in either the on-safe or off-safe position has not been removed or the two recesses on the thumb safety lever filled or smoothed to be a groove and not a pair of spaced recesses (or the retention means otherwise defeated), then the spring rod 20 must be of sufficient resilient strength to readily overcome the relatively low position-retaining strength of the originally equipped spring knob and recess arrangement of the thumb safety lever, which is feasible within the scope of the invention. However, I prefer to reshape the two "recesses" on the thumb safety lever by forming originally in a newly made modified safety lever 14 or by cutting (plowing a groove) to modify the area in an existing lever so that the area includes an elongate groove 38 (see FIG. 7) in which the spring biased knob 42 resides (above notch 12 to prevent knob 42 snapping into notch 12)

to aid in securing the modified thumb safety lever 14 against wandering laterally outward away from the frame of the pistol 10, although lateral wandering would not normally be a problem in any case, particularly if the second end of spring 20 rest atop thin floor 40 in notch 12 as anticipated above and generally shown in FIG. 7.

Figure 5:
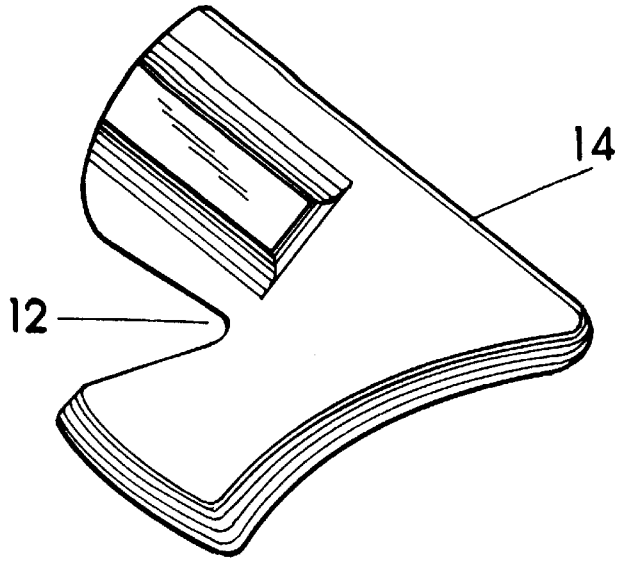
FIG. 5 is an enlarged perspective view of a thumb safety lever removed from the pistol and with a notch or opening added to receive an end of a spring rod.
Figure 6:
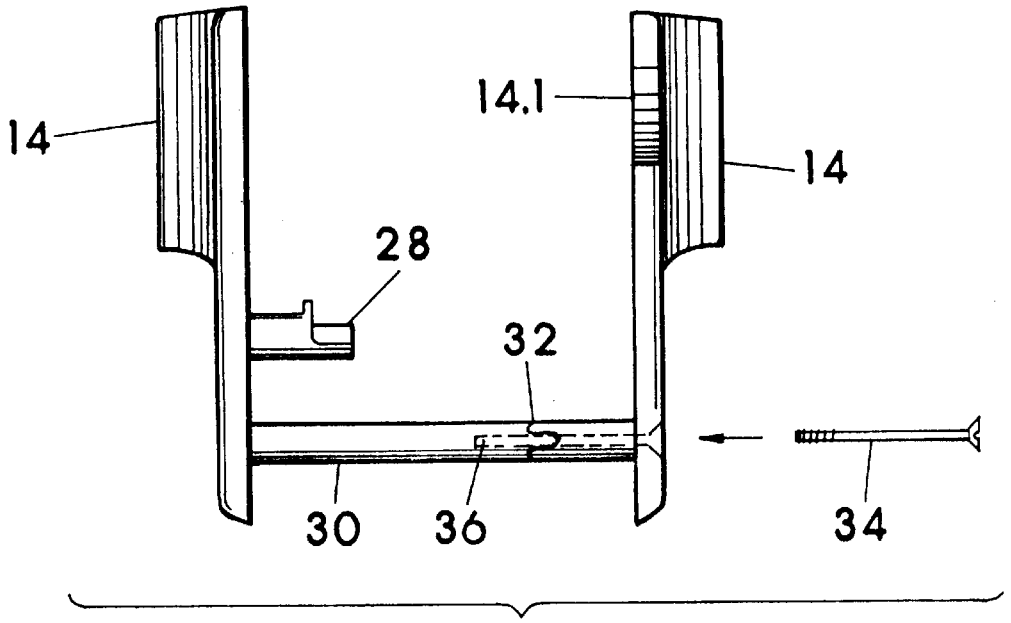
FIG. 6 is a top elevational view of a left side thumb safety lever for placement on the left side of the frame of the pistol, and on the right side of the drawing is a right side thumb safety lever of an ambidextrous lever arrangement. A central shaft and connecting screw are shown to connect and link movement in the two levers.

Additional steps, the order of which relative to some of the above steps in some cases re-arrangeable as those skilled in the art will recognize with continued reading, to make the pistol ambidextrous with a normally-on, momentary-off safety in accordance with the present invention could include the steps of:

pivotally mounting a second safety lever 14.1 exposed on an opposite side of the pistol 10 from the safety lever 14 defining the notch 12; and coupling the safety lever 14 defining the notch 12 and the second safety lever 14.1 with connecting structure for translating movement of one of the safety levers into like movement in the other of the safety levers. The two thumb levers 14, 14.1 are, when affixed together, both in the same attitude, i.e., both up in the on safe position together and when manually pushed into the off safe position both downward together. FIG. 6 shows a left 14 and a right 14.1 side thumb safety lever, the lock stud is also shown on the left lever 14. Although it cannot be seen in the FIG. 6 view, the thumb safety lever 14 on the left is a modified safety lever including a notch 12 as shown in FIG. 5. In FIG. 6 is shown a central pin 30, being the pivot pin of the levers which is normally within a bore transversely through the pistol frame. The pin 30 is connected at each outward end thereof to a safety lever, the two-piece pin 30 coupled in the middle with a tongue and groove 32 (tongue on one piece end of 30 and groove on other piece end of 30) to prevent axial rotation of the two sections of the pivot pin 30 relative to one another, and with a connecting screw 34 aligned for insertion into a bore 36 lengthwise in the pin 30 to threadably connect with the far pin 30 portion to connect the two pin portions to prevent their separation (spreading) from one another and to keep the tongue and groove joint 32 engaged. The pin 30 portions and thumb safety levers 14, 14.1 are initially applied to the pistol 10 from opposite sides of the frame, the pin 30 two terminal ends at the tongue and groove 32 engaged (interlock) with one another within the transverse bore of the pistol frame, and then the connecting screw 34 is applied to prevent the spreading of the levers 14, 14.1 and removal thereof from the pistol, as those skilled in the art will recognize.

From another viewpoint the invention can be viewed as an improved Model 1911 pistol or style pistol having a normally-on, momentary-off safety associated with the exposed thumb safety lever and its associated attached lock stud (k3 in the Browning 1913 patent) positioned internally of the pistol. The pistol improved in accordance with the invention in one embodiment uses the multi-positional side thumb safety lever 14 modified to include an opening or notch 12, and in another embodiment provides an additional or second thumb safety lever 14.1 on the opposite side of the frame from the first thumb safety lever 14 so that the pistol 10 is ambidextrously arranged or can be fully operated in either the right or left hand. The improved pistol in accordance with the invention can be newly manufactured at a factory, or alternatively can be the end result of improving modifications to pre-manufactured or already existing pistols such as the Model 1911 pistol or style of pistol, since a large number of such pistols are in existence and could be improved and made more safe as herein described.

The improvement includes the addition of biasing spring 20 which in this example is an elongated spring rod structured, positioned and partially loaded to bias the thumb safety lever 14 (and 14.1 if ambidextrous) upward into the on-safe position so the pistol 10 is always normally (on the shelf or in the holster or otherwise not manually aided) in the on-safe position, and automatically moving or moved to the on-safe position. The pistol in accordance with the invention can only be readied for firing, assuming all else is properly readied, by way of the shooter intentionally depressing the thumb safety lever 14 (or 14.1 if the pistol is arranged to be ambidextrous) downward, overriding the spring 20 force of holding the thumb safety lever upward and moving the safety lever 14 and associated firing component locking gear (lock stud 28 for one) into the off-safe position which if the pistol is otherwise fully readied allows the firing of the pistol. Upon release of the depressing pressure of the thumb on the safety lever 14, the spring 20 automatically and virtually instantaneously returns the thumb safety lever upward into the on-safe position wherein the safety remains in the on-safe position until again manually depressed in preparation for firing the pistol.

Although such a pistol in accordance with the present invention is substantially improved in terms of safety when only a single safety thumb lever 14 is installed on the pistol, for certain combat or self-defense situations, the pistol might be viewed as needing an ambidextrous or two thumb safety lever arrangement for the reasons previously stated. For citizen self defense or as a target shooting pistol, the ambidextrous nature of one embodiment may not be viewed as all that important, but for law enforcement officers and those in military situations, the ambidextrous nature of a normally-on, momentary-off safety as herein described can be viewed as critically important.

A further description of a pistol in accordance with the present invention will now be given with reference to the drawings. FIG. 1 shows a left side view of a Model 1911 pistol 10 modified in accordance with the invention to include notch 12 in the thumb safety lever 14, notch 12 positioned below the groove 38 or glide path (groove 38 as shown in FIG. 7) of the spring biased knob discussed above, an elongated groove or space 16 in the back side of the left grip panel 18, and a spring rod 20 trapped within the confines of the space 16 and the notch 12 and with the relative angles of the space 16 and notch 12 to one another such that the resilient spring rod 20 is retained under bending force but in its most relaxed position abutted against the side of the lever 14 in the area thereof defining notch 12 and having pushed the thumb safety lever 14 into the upper or on safe position. Even with the lever 14 in the upper or on safe position, the spring rod 20 is preferably still under some bending load, trying to move further upward, and this so as to positively hold the thumb safety lever 14 in the on safe position. As previously described, the shooter can apply his thumb to the top surface of the thumb safety lever 14 to depress the lever 14 downward into the off safe position, a process which overrides spring rod 20 causing it to bend or further bend long its length and at its second end in and adjacent notch 12 and to move downward as shown in FIG. 1 wherein a hand and thumb are shown in broken lines. The downward bending movement of rod 20 is further facilitated by space 16 being specifically shaped to include an enlarged area or space 22 near the opening 24 at the terminal edge of grip panel 18 and below where the rod 20 normally resides, the enlarged space 22 shown in FIG. 1 in broken lines and in FIG. 3 providing space for a strong, not easily bent spring rod 20 to be readily moved into, flexing over an extended length, when the shooter depresses the thumb safety lever 14 into the off-safe position. The lever 14 is instantaneously returned to the on-safe position by spring rod 20 upon the shooter releasing the depressing pressure against lever 14. Space 16 includes a narrow closed end 26 which closely or snugly fits laterally against the first end portion of spring rod 20 and in effect causes the spring 20 to be normally positioned and to extend outward from grip panel 18 at the desired angle relative to notch 12. The first portion of spring rod 20 is mounted to a stationary portion of the pistol by way of grip panel 18. The closed terminal back end of space 16 and the closed terminal back end within notch 12 (the end of the notch 12 nearest the pivotal point of the lever 14) serve to entrap the elongate spring rod 20, when the rod 20 is of proper length, and prevent it from sliding lengthwise from its desired mounting position. The back side of space 16 nearest the frame of the pistol in this example is formed by the grip frame, and thereby the spring rod 20 extends parallel to the surface of the frame beneath the grip panel 18. Grip panel 18 could be structured to provide an integral back panel between the frame and the spring. Space 16 is shallow and maintains the rod 20 near the surface of the frame of the pistol. With the modified grip panel 18 installed on the pistol frame, and the modified thumb safety lever 14 properly mounted on the pistol 10, assuming spring rod 20 is of the proper length, I simply push the first end of the rod 20 into and through opening 24 of space 16 and bending the second portion of the rod 20 upward slightly, force the first portion of the rod 20 all of the way into space 16 and then position the second portion of the spring rod 20 over about the center of notch 12 and left it snap into place. A hard pushing tool such as a side of a small straight blade screw driver tip can be used to push the spring rod into place if desired. It should be noted that if the pistol 10 is setup with left and right hand side thumb safety levers, i.e., ambidextrously arranged as previously detailed, the space 16, notch 12 and spring rod 20 could be applied to the right side of the pistol and pistol frame. It should also be noted that, as those skilled in the art understand, that the notch in the breech-slide on the left side of the pistol such as the Model 1911 is not present on the right side of the pistol and breech-slide, however clearance between the right side thumb safety levers 14.1 and the near edge of the breech-slide is provided in ambidextrous arrangements so that interference between the right side thumb safety lever and the breech-slide does not occur with the thumb safety in the upward or on safe positions. The left hand side thumb safety lever 14 as shown in FIGS. 1 and 2 is sufficiently long and properly shaped to move upward into the notch in the breech-slide when in the on safe position.

Spring rod 20 in the example shown and described is simply a straight, elongated spring steel rod, which is a shape and material which is readily available in many sizes and strengths, as well as expected bend or flex cycles, and is available inexpensively. Other suitable materials to define a spring can also be used within the scope of the invention. The example shown and described is simple, effective and inexpensive, although I suppose other more complicated and possibly more expensive arrangements such as using permanently bent or coiled springs could be used and possibly within the scope of the invention, and possibly attached internally of the pistol frame with a first end against some stationary portion of the pistol such as the frame and the second end of the spring against some movable part of the safety structuring inside the frame (all concealed) which is sufficiently structurally associated or connected with and to the thumb safety lever exposed on the exterior of the pistol to normally move the safety into on-safe position with the thumb lever also (simultaneously) being moved up and normally in the on-safe position, and with the spring overrideable with thumb pressure to move the safety lock components and thumb lever-into the off-safe position. However, as shown in the drawings, preferably a portion which is the second portion of spring rod 20 is exposed for inspection which I think is desirable so that the pistol owner or user can in an instant visually inspect and mechanically test the normally-on, momentary-off safety arrangement. As previously described, the pistol 10 in some use situations can be viewed as needing to be ambidextrous in regards to thumb safety lever. FIG. 6 shows is an enlarged top elevational view of a left side thumb lever 14 and a right hand thumb safety lever 14.1. The lock stud 28 is also shown. Although it cannot be seen in the FIG. 6 view, the thumb safety lever on the left is a modified safety lever including the notch 12 as shown in FIG. 5 and previously detailed. In FIG. 6 is shown the central pin 30, being the pivot pin of the levers 14, 14.1 which is normally within the bore through the pistol 10 frame. The pin 30 is connected at each outward end thereof to the thumb safety levers. The pin 30 being a two piece pin severed transversely and coupled at the transverse seam or separable joint with the tongue and groove 32 which interlock to prevent axial rotation of the two sections of the pivot pin 30 relative to one another, and with the connecting screw 34 aligned for insertion into the bore 36 as above described.

Although I have herein detailed best modes of carrying out the invention, i.e., structure, use and methods in accordance with the principles of the invention, the true scope of invention should not be overly limited by the examples provided in the specification and drawings, but should be determined by the broadest possible reasonable interpretation of the language of the claims and reasonable structural and or functional equivalents of that specifically claimed.

I claim:

1. An improved pistol of the type capable of being held and operated in a single hand and including means for firing bullets from cartridges responsive to reciprocating motion of a trigger, the pistol further including a multi-positionable safety lever pivotally supported by a frame of the pistol and exposed on a side of the pistol for allowing manual manipulation of said safety lever with a thumb of a hand grasping the pistol for manipulating lock means of the pistol for locking a hammer, a breech-slide and said trigger of the pistol with said safety lever in a first position wherein said pistol cannot be fired, and for unlocking said hammer, said breech-slide and said trigger with said safety lever in a second position to allow firing of the pistol;

wherein the improvements comprise:

a flexible and resilient elongate rod positioned with a first portion of said rod within an elongate space defined primarily by a grip panel of the pistol, a second portion of said rod positioned outward of a terminal edge of said grip panel and residing within an opening defined by said safety lever; said rod held angularly positioned by portions of said grip panel relative to said safety lever so as to have said second portion of said rod engage said safety lever and bias said safety lever into said first position; said rod of a flexible nature such that said safety lever can be manually depressed to bend said rod and to be moved into said second position by a thumb of a hand grasping the pistol, wherein upon release of manual depression of said safety lever said rod returns said safety lever back into said first position.

2. An improved pistol according to claim 1 wherein said safety lever is a first safety lever and the pistol includes a multi-positional second safety lever pivotally supported by said frame and exposed on a side of the pistol opposite from the first safety lever, the first and the second safety levers coupled to one another by means connecting the first and second safety levers for translating movement of one of the safety levers into like movement in the other of the safety levers.

3. An improved pistol of the type capable of being held and operated in a single hand and including means for firing bullets from cartridges responsive to reciprocating motion of a trigger, the pistol including a multi-positionable first safety lever pivotally supported by a frame of the pistol and exposed on a first side of the pistol for allowing manual manipulation of said first safety lever with a thumb of a hand grasping the pistol for manipulating lock means of the pistol for locking cartridge firing components of the pistol with said first safety lever in a first position wherein the pistol cannot be fired, and for unlocking said cartridge firing components with said first safety lever in a second position to allow firing of the pistol; the pistol further including a multi-positional second safety lever pivotally supported by said frame of the pistol and exposed on a second side of the pistol opposite from said first safety lever, the first and the second safety levers coupled to one another by means connecting the first and the second safety levers for translating movement of one of the safety levers into like movement in the other of the safety levers;

wherein the improvements comprise:

a flexible and resilient elongate rod positioned with a first portion of said rod within an elongate space defined primarily by a grip panel of the pistol, a second portion of said rod positioned outward of said grip panel and residing within an opening defined by one of the safety levers; said rod engaged with means for angularly positioning said rod relative to said opening so as to have said second portion of said rod engage the safety lever defining said opening and bias the first and second safety levers into said first position wherein said cartridge firing components are locked by said lock means; said rod of a sufficient flexible nature such that either of the safety levers can be manually depressed to bend said rod and to be moved into said second position by a thumb of a hand grasping the pistol, wherein upon release of manual depression of the safety lever said rod by way of its resiliency returns the safety levers back into said first position.

4. An improved pistol of the type capable of being held and operated in a single hand and including means for firing bullets from cartridges responsive to reciprocating motion of a trigger, the pistol further including movable safety structural components for allowing the pistol to be selectively placed in a non-fireable state and a fireable state; said safety structural components including a multi-positionable first safety lever pivotally supported by a frame of the pistol and exposed on a first side of the pistol for allowing manual manipulation of said first safety lever with a thumb of a hand grasping the pistol for locking cartridge firing components of the pistol with said first safety lever in a first position wherein the pistol cannot be fired, and for unlocking said cartridge firing components with said first safety lever in a second position to allow firing of the pistol; a multi-positional second safety lever pivotally supported by said frame of the pistol and exposed on a second side of the pistol opposite from said first safety lever, the first and the second safety levers coupled to one another by means connecting the first and the second safety levers for translating movement of one of the safety levers into like movement in the other of the safety levers;

wherein the improvements comprise:

a resilient spring with a first portion of said spring engaged with a stationary portion of the pistol; a second portion of said spring engaged with a movable component of said safety structural components and in sufficient operative association with the first and second safety levers for normally holding the pistol in the non-fireable state with the first and second safety levers in said first position; said spring of a sufficient flexible nature such that either of the safety levers can be manually depressed to override said spring and to be moved into said second position by a thumb of a hand grasping the pistol, said spring of sufficient resiliency to return both the first and second safety levers to said first position upon termination of manual depression against the safety levers.

5. A method of converting an operable pistol to having a normally on-safe, momentary off-safe safety; the operable pistol for conversion of the type of pistol having an existing pivotally mounted manual thumb actuated safety lever on a side of the pistol and adjacent a grip panel and with said existing safety lever of a type which can reside in a off-safe position until manually moved into a on-safe position;

said method of converting comprising the steps of:

(a) removing the grip panel adjacent to the existing safety lever from the pistol;

(b) mounting a modified grip panel onto the pistol in the location of the previously removed grip panel; said modified grip panel modified to define a space having an opening into the space adjacent the existing safety lever;

(c) removing the existing safety lever from the pistol;

(d) mounting a modified safety lever onto the pistol in the location of the previously removed safety lever; said modified safety lever modified to define an opening;

(e) installing an elongate flexible and resilient rod under bending load into said space of the modified grip panel and extending into said opening of said modified safety lever with said bending load biasing and pushing said modified safety lever into the on-safe position; said rod of sufficient flexibility to allow manual depression of said modified safety lever into the off-safe position, said rod of sufficient resiliency to return said modified safety lever into the on-safe position upon release of the manual depression.

6. A method of converting according to claim 5 further including pivotally mounting a second safety lever exposed on an opposite side of the pistol from said safety lever defining said opening;

coupling said safety lever defining said opening and said second safety lever with connecting means for translating movement of one of the safety levers into like movement in the other of the safety levers.

* * * * *